US008671864B2

(12) United States Patent
Lindblade et al.

(10) Patent No.: US 8,671,864 B2
(45) Date of Patent: Mar. 18, 2014

(54) TURRET BEARING STRUCTURE FOR VESSELS

(75) Inventors: Stephen Lindblade, Waller, TX (US); William Fontenot, Houston, TX (US); Caspar Heyl, Houston, TX (US)

(73) Assignee: SOFEC, Inc., Houston, TX (US)

( * ) Notice: Subject to any disclaimer, the term of this patent is extended or adjusted under 35 U.S.C. 154(b) by 0 days.

(21) Appl. No.: 13/446,857

(22) Filed: Apr. 13, 2012

(65) Prior Publication Data

US 2013/0269582 A1 Oct. 17, 2013

(51) Int. Cl.
*B63B 21/00* (2006.01)

(52) U.S. Cl.
USPC ..... 114/230.12

(58) Field of Classification Search
USPC ..... 114/230.12, 230.15
See application file for complete search history.

(56) References Cited

U.S. PATENT DOCUMENTS

| | | | | | |
|---|---|---|---|---|---|
| 4,343,055 | A | | 8/1982 | Bergling | |
| 4,698,038 | A | | 10/1987 | Key et al. | |
| 4,701,143 | A | * | 10/1987 | Key et al. | 441/5 |
| 4,753,553 | A | | 6/1988 | Carlsen et al. | |
| 4,841,895 | A | * | 6/1989 | Brewerton | 114/230.12 |
| 4,955,310 | A | * | 9/1990 | Pollack | 114/230.12 |
| 5,052,322 | A | | 10/1991 | Poldervaart et al. | |
| 5,346,314 | A | * | 9/1994 | Perratone et al. | 384/97 |
| 5,359,957 | A | | 11/1994 | Askestad | |
| 5,381,750 | A | * | 1/1995 | Pollack | 114/230.12 |
| 5,515,804 | A | * | 5/1996 | Pollack | 114/230.12 |
| 5,746,148 | A | * | 5/1998 | Delago | 114/230.12 |
| 5,762,017 | A | * | 6/1998 | Groves | 114/230.12 |
| 5,782,197 | A | | 7/1998 | Pollack | |
| 5,850,800 | A | | 12/1998 | Commandeur | |
| 5,860,382 | A | * | 1/1999 | Hobdy | 114/230.15 |
| 5,913,279 | A | * | 6/1999 | Braud et al. | 114/230.12 |
| 5,957,076 | A | | 9/1999 | Pollack et al. | |
| 6,164,233 | A | | 12/2000 | Pollack et al. | |
| 6,263,822 | B1 | | 7/2001 | Fontenot et al. | |
| 6,269,762 | B1 | * | 8/2001 | Commandeur | 114/230.12 |
| 6,474,252 | B1 | | 11/2002 | Delago | |
| 6,477,974 | B2 | * | 11/2002 | Hobdy | 114/230.12 |
| 6,502,524 | B1 | | 1/2003 | Hooper | |
| 6,708,639 | B2 | | 3/2004 | Cottrell et al. | |
| 6,827,493 | B2 | | 12/2004 | Hooper | |
| 7,063,032 | B2 | | 6/2006 | Lindblade et al. | |
| 7,225,749 | B2 | | 6/2007 | Boatman | |
| 7,891,508 | B2 | | 2/2011 | Delago | |
| 2010/0020903 | A1 | | 1/2010 | Hue et al. | |

* cited by examiner

*Primary Examiner* — Lars A Olson
*Assistant Examiner* — Jovon Hayes
(74) *Attorney, Agent, or Firm* — Gary L. Bush; Andrews Kurth LLP

(57) ABSTRACT

A radial bearing arrangement (2) including a turret (14) carried by a vessel (10), the turret (14) having an outer annular rail (38) secured about its outer circumference. The radial bearing arrangement (2) also includes a plurality of rollers (104) attached to the vessel (10) via bearing assemblies (74). The bearing assemblies (74) are arranged and designed to urge the rollers (104) into contact with the annular rail (38), and to limit radial movement of the vessel (10) relative to the turret (14). A plurality of bearing pads (114) are attached to the vessel (10) and positioned circumferentially between the bearing assemblies (74). The bearing pads (114) are arranged and designed to contact the rail (38) under peak loading to limit radial movement of the vessel (10) relative to the turret (14).

10 Claims, 10 Drawing Sheets

TURRET BEARING STRUCTURE FOR VESSELS

BACKGROUND OF THE INVENTION

1. Field of the Invention

This invention relates to a turret bearing structure for vessels such as offshore drilling or production vessels, and more particularly to such a turret bearing structure having bearing pads for reacting horizontal loads between the turret structure and the vessel.

2. Description of the Prior Art

Heretofore, vessel mooring systems have been provided in which a vessel may weathervane about a turret which is normally anchored to the sea floor. The turret extends through a moon pool or cylindrical opening that extends through the hull of the vessel. The vessel is supported for rotation with respect to the turret by bearing structures placed between the turret and the vessel. Horizontal and vertical bearings transfer horizontal and vertical loads between the turret and the vessel.

U.S. Pat. No. 5,746,148, to Delago issued May 5, 1998, shows a radial roller assembly which provides radial support of a rotatable vessel to a fixed cylindrical turret in order to resist horizontal forces. The radial roller assembly includes wheels that are arranged to contact a rail provided around the turret and that are arranged to roll about the rail depending on the position of the rotating vessel relative to the fixed turret. The wheels are each arranged in an individual support carriage that includes a spring for absorbing the horizontal load placed on the wheels by the vessel.

U.S. Pat. No. 5,860,382 to Hobdy issued Jan. 19, 1999 shows a radial bearing arrangement for radially supporting a vessel with respect to a substantially vertically aligned cylindrical turret which is rotatably mounted within a vertical opening or well of the vessel. The radial bearing arrangement includes a rail secured to the outer circumference of the turret and plurality of radial bearing assemblies mounted on the structure of the vessel and spread at arcuate intervals about the outer circumference of the turret for engaging the rail. Each radial bearing assembly includes a roller rotatably mounted thereon for bearing contact against the bearing rail on the turret. A pair of concentric spring assembly continuously urge a follower against the roller frame into riding contact with the turret rail.

One shortcoming of the prior art is that the number of radial roller assemblies that can be used to absorb horizontal loads is limited by the geometry of the vessel well that surrounds the turret. That is, the well has a fixed diameter, and the number of radial roller assemblies that can be placed at the well is limited to the number that can fit around that diameter. This means that the radial load capacity of the roller assemblies is limited. This limitation may be a problem if the horizontal loads exerted between the vessel and the turret exceed the radial load capacity of the roller assemblies.

3. Identification of Objects of the Invention

It is an object of the invention to overcome the disadvantages of the prior art.

Another object of the invention is to provide a radial bearing arrangement having bearing pads arranged to absorb radial loads.

Another object of the invention is to provide a radial bearing arrangement that has a secondary stop to assist a radial spring assembly in limiting radial movement of a vessel relative to a turret.

Another object of the invention is to provide a radial bearing arrangement with fewer radial rollers for the same load capacity as existing designs.

Another object of the invention is to provide a radial bearing arrangement between a vessel and turret which has an increased radial load capacity for the same number of radial rollers as existing designs.

SUMMARY OF THE INVENTION

The invention is directed to a radial bearing arrangement for radially supporting a substantially vertically aligned cylindrical turret rotatably mounted within a vertical opening, or well, in a vessel. The radial bearing arrangement includes a rail secured to the outer circumference of the turret and a plurality of radial bearing assemblies and/or bearing pads mounted on the structure of the vessel. The radial bearing assemblies and/or bearing pads are arcuately spaced about the outer circumference of the turret for engaging the rail.

In one embodiment of the invention, the radial bearing arrangement has bearing assemblies with rollers positioned to contact the turret rail, as well as bearing pads positioned circumferentially between the rollers. In this embodiment, the bearing assemblies absorb radial forces exerted on the rollers by the turret. The bearing pads are positioned to come into contact with the rail of the turret when some of the bearing assemblies are compressed under peak radial loads. The bearing pads help to resist the radial forces between the vessel and the turret. Alternatively, the bearing pads may be positioned to come into contact with the turret at a bearing pad contacting surface that is vertically offset from the rail.

Another embodiment of the invention is a radial bearing arrangement where the turret is surrounded by bearing pads alone, without rollers or other bearing assemblies. In this embodiment, the bearing pads alone resist the radial forces exerted by the vessel with respect to the turret, and help maintain the radial position of the turret relative to the vessel.

Another embodiment of the invention is a radial bearing arrangement having both moveable and fixed bearing pads. The moveable pads are attached to spring packs that maintain contact between the moveable pads and the turret and that absorb radial forces. The fixed pads are positioned to come into contact with the turret when the moveable pads and spring packs are compressed under peak radial loads, thereby helping to resist the radial forces between the turret and the vessel.

Other features and advantages of the invention are described in the following specification and drawings.

DESCRIPTION OF EMBODIMENTS OF THE INVENTION

Figure 1:
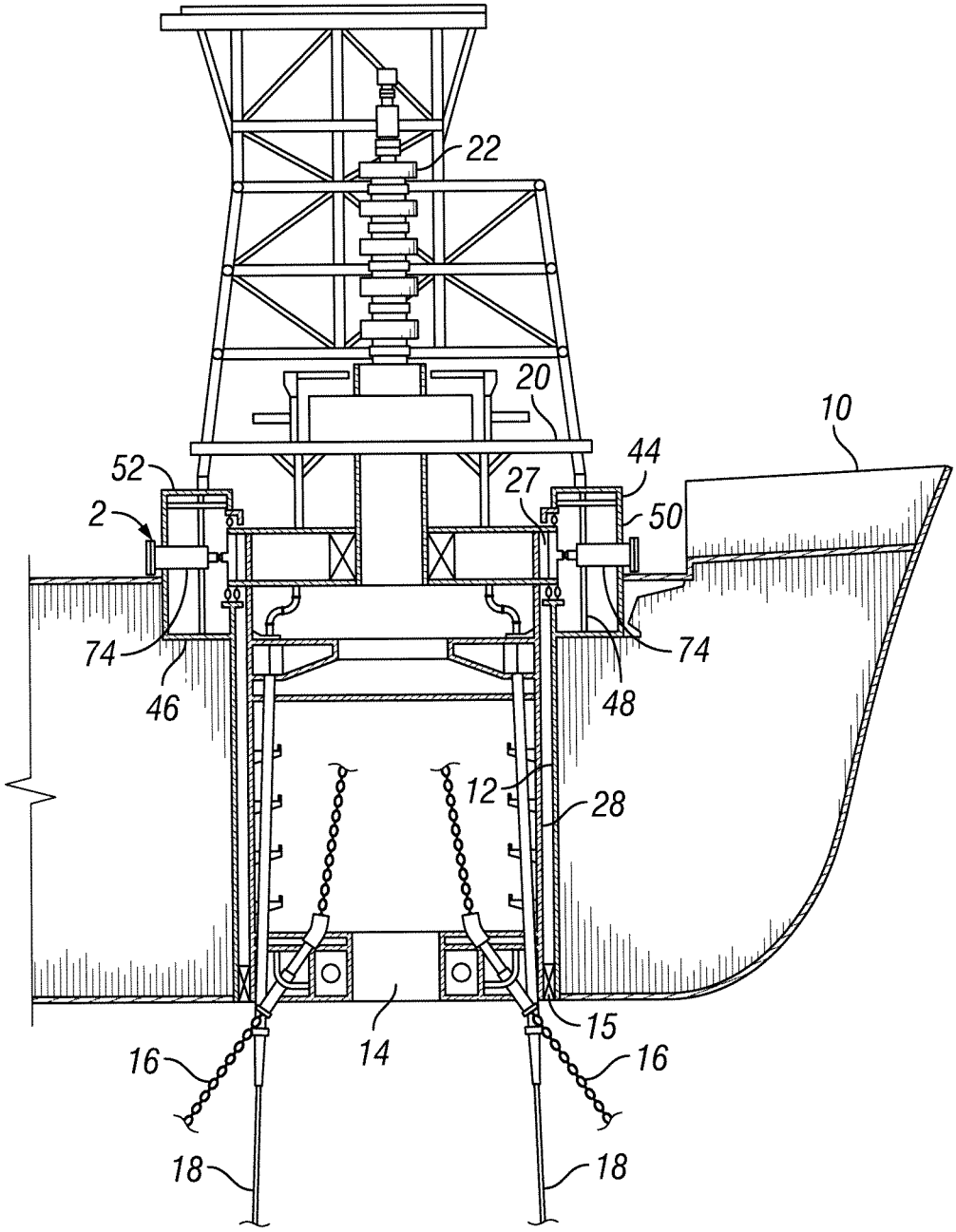
FIG. 1 is a longitudinal section of the bow of a vessel including a turret installed in a well in the bow.

FIG. 1 shows the bow of a vessel 10 having a well or moon pool 12 extending through the hull of vessel 10. Mounted within well or moon pool 12 is a turret generally indicated at 14 about which vessel 10 may weathervane. Well 12 is normally of a circular cross section, and turret 14 is typically of a cylindrical shape to fit within well 12. Anchor legs 16 are connected to turret 14 and may be secured to the sea bed by suitable anchors to restrict rotation of turret 14. Risers 18 extend to subsea wellheads or distribution facilities on the sea floor and are connected to turret 14. A manifold deck 20 is supported on the upper end of turret 14 and includes valves connected to risers 18. A swivel stack shown generally at 22 extends upwardly from turret 14 and manifold deck 20 and allows fluids to be transferred from the turret 14 to the vessel 10. Turret 14 is supported on vessel 10 by an upper bearing assembly and an optional lower bearing assembly 15.

Figure 2:
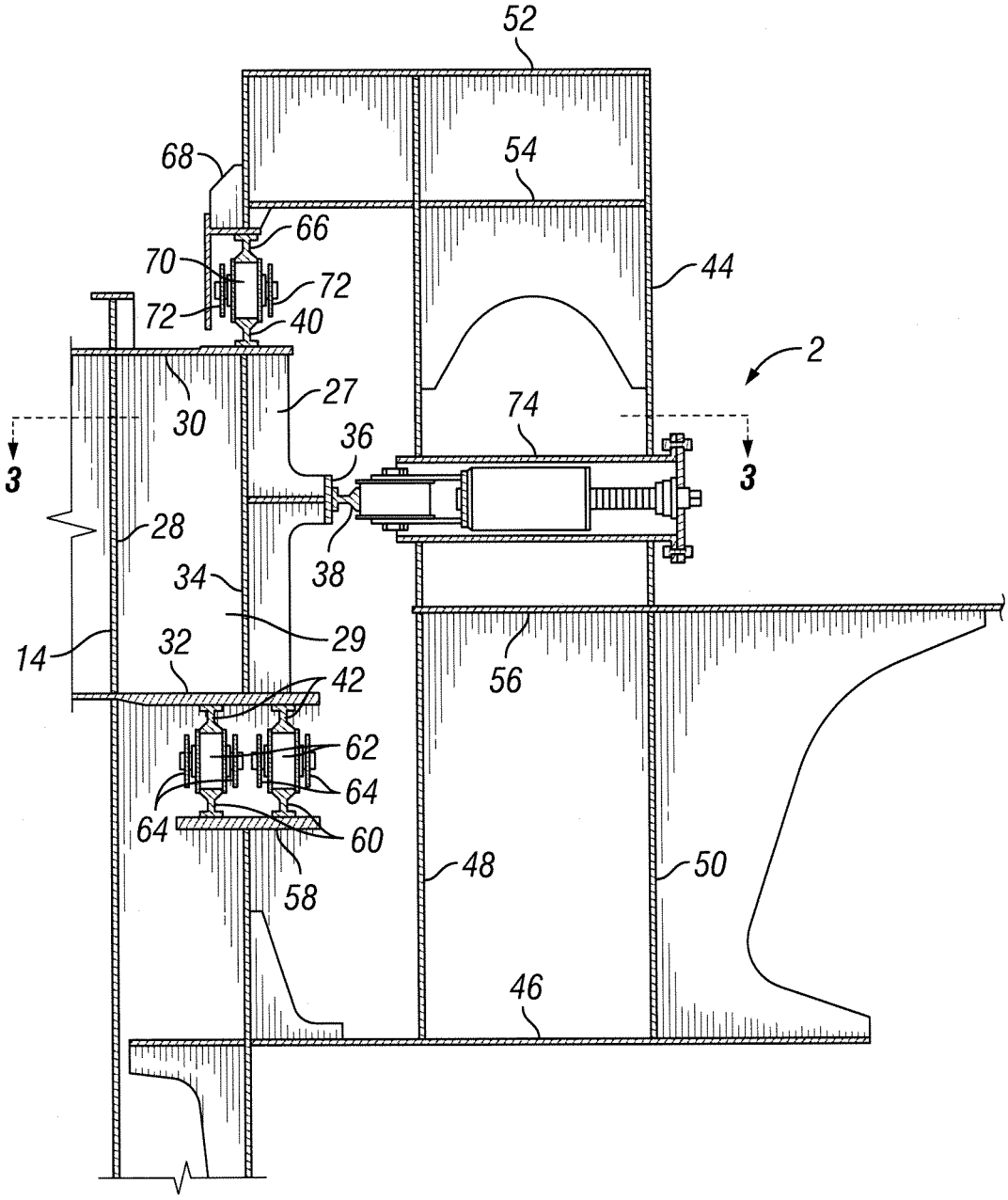
FIG. 2 is an enlarged fragment of FIG. 1 which shows an upper bearing arrangement including radial and vertical bearing assemblies between the turret and the vessel which permit weathervaning of the vessel about the turret.
Figure 3:
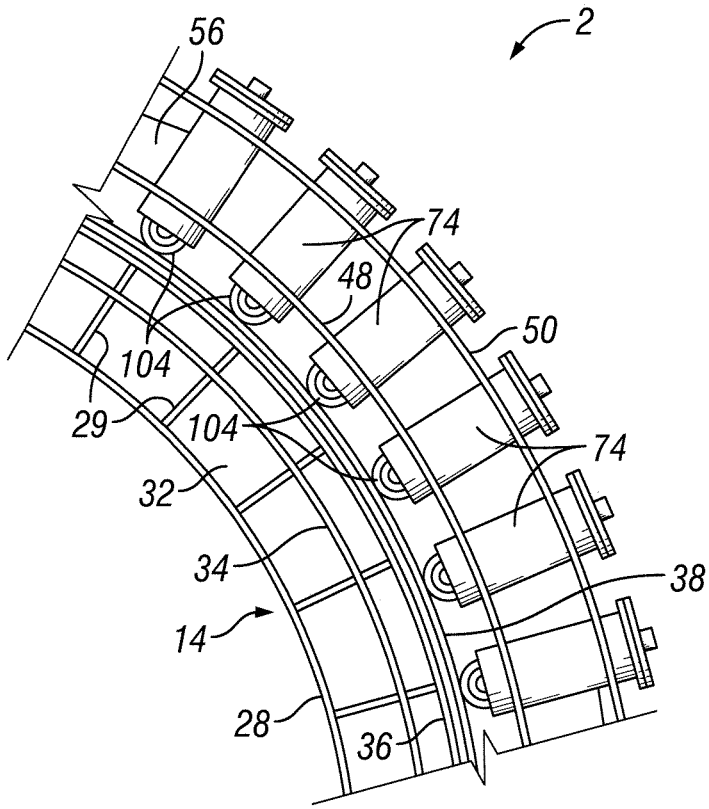
FIG. 3 is a plan view of a radial bearing arrangement between the vessel and the turret for reacting radial loads between the vessel and turret, the view taken generally about line 3--3 of FIG. 2 and including a plurality of radial bearing assemblies arcuately spaced about the outer circumference of the turret.

As shown in FIG. 1 and particularly in FIGS. 2 and 3, turret 14 includes a cylindrical body 28 having an upper radial extension or arm 27 including a pair of radial flanges or plates 30, 32 extending outwardly from cylindrical body 28. A vertical annular web 34, which is concentric with body 28, reinforces flanges 30 and 32. Reinforcing webs 29 are secured between cylindrical body 28 and annular web 34.

Extending radially outwardly from web 34 is an annular T-shaped rail support 36. Mounted on rail support 36 is an annular rail 38 which extends about the outer circumference of rail support 36 to provide a radial bearing member about the outer periphery of turret 14 for radial loads between the turret 14 and the vessel 10.

Upper plate 30 has an upper rail 40, and lower plate 32 has at least one set (typically a pair) of lower rails 42 to provide bearing members on turret 14 for vertical loads between turret 14 and the vessel 10. A turret support structure generally indicated at 44 is fixed to a lower deck portion 46 of vessel 10 to permit weathervaning of vessel 10 about turret 14. A pair of concentric rings 48 and 50 extend upwardly vertically from deck portion 46. An upper annular cover plate 52 extends over concentric rings 48 and 50. Horizontal stiffeners 54 and 56 are secured between rings 48 and 50.

A T-section 58 (FIG. 2) extends upwardly from deck portion 46, and a pair of parallel lower rails 60 are mounted thereto in spaced relation to opposed rails 42 on turret 14. A plurality of rollers 62, mounted between plates 64, is placed between rails 42 and 60 for rolling vertical support of the turret 14 on the vessel 10.

An upper rail 66 (FIG. 2) is secured by brackets 68 to stiffener 54 and extends downwardly therefrom in a vertically spaced relation to upper rail 40 on turret 14. Rollers 70 mounted between plates 72 are positioned between rails 40 and 66 and assist in maintaining turret 14 in axial alignment with well 12.

A radial bearing arrangement 2, including radial bearing assemblies 74, may be employed to maintain the relative radial positions of turret 14 and the vessel 10. An example of such a radial bearing arrangement is disclosed in U.S. Pat. No. 5,860,382 to Hobdy, which issued Jan. 19, 1999, the disclosure of which is hereby incorporated herein by reference.

Figure 4:
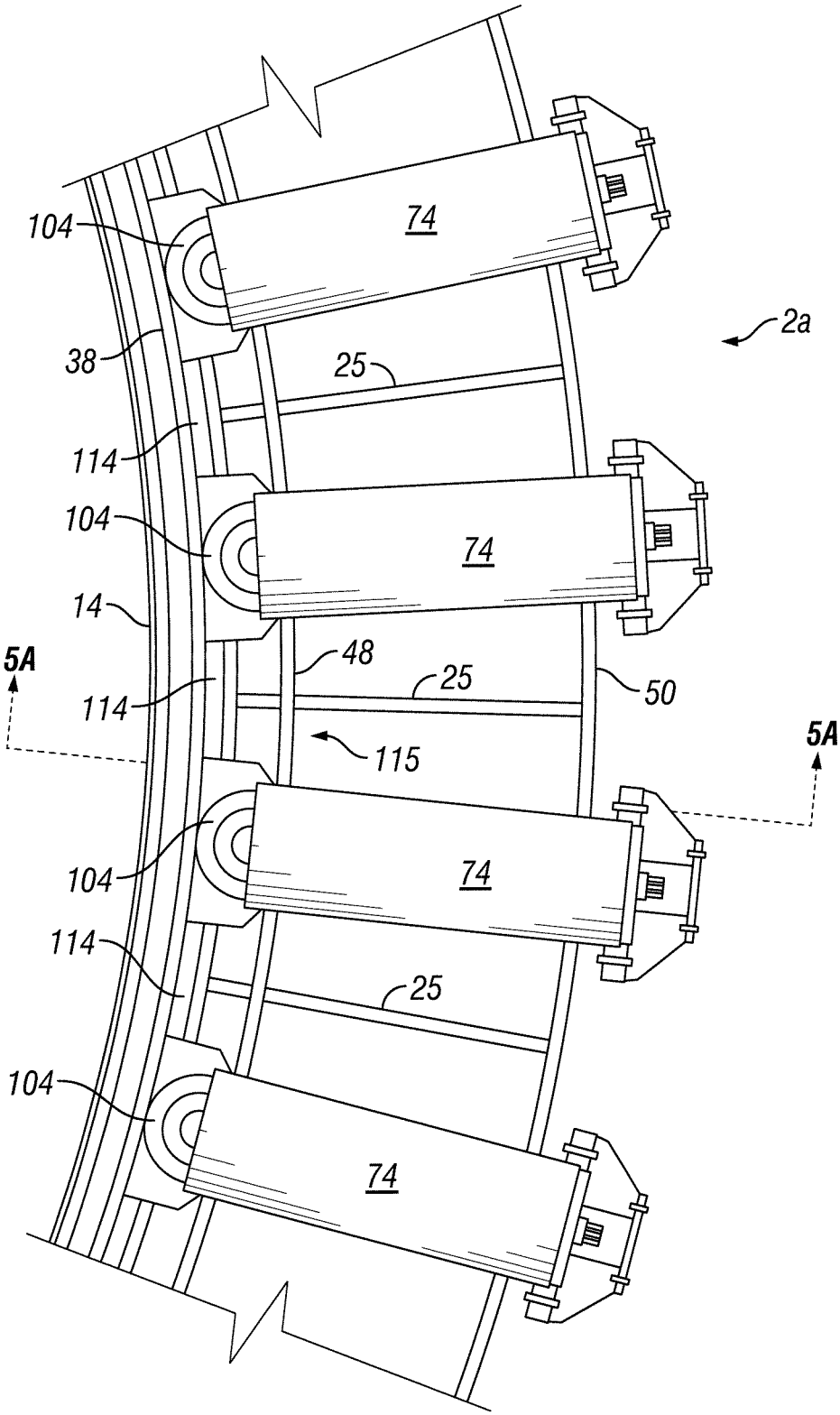
FIG. 4 is a plan view of a radial bearing arrangement for reacting radial loads of the turret according to an embodiment of the invention, and taken generally about line 3--3 of FIG. 2, including a plurality of radial bearing assemblies arcuately spaced about the outer circumference of the turret, and further including bearing pads placed alternately between the radial bearing assemblies.

FIG. 4 illustrates an embodiment of the invention in which the radial bearing arrangement 2 includes a plurality of bearing pads 114, such as Orkot® pads, in addition to the radial bearing assemblies 74. "Orkot" is a registered trademark of Trelleborg Sealing Solutions. The bearing pads may be made from a variety of suitable bearing materials. The bearing pads 114 supported by members 25 from vessel rings 48, 50 are placed circumferentially between the radial bearing assemblies 74 in alternating fashion, in the arrangement 2*a* as shown in FIG. 4. The purpose of the bearing pads 114 is to provide a secondary stop to relative movements between the vessel 10 and the turret 14 during peak loads. For example, as the vessel 10 and moon pool 12 and rollers 104 move in the direction of arrow 115, compressive load is put on radial bearing assemblies 74. Peak loading of the radial bearing assemblies 74 is caused by ovaling of the moon pool (well) 12 because of wind and sea currents acting on the vessel 10. Other causes of loading include mooring and riser loads and inertia loads on the turret 28 itself.

It is possible that under peak loading, the radial bearing assemblies 74 will approach their maximum load. The bearing pads 114 are positioned so that as the radial bearing assemblies 74 approach their maximum load, the bearing pads 114 contact the rail 38 on turret 14 and take a share of the compressive load and limit the load on the radial bearing assemblies 74. Providing bearing pads 114 as shown in FIG. 4 allows the pads to take a share of the load resulting in the need for fewer radial bearing assemblies 74 in the radial bearing arrangement 2*a*.

Figure 5A:
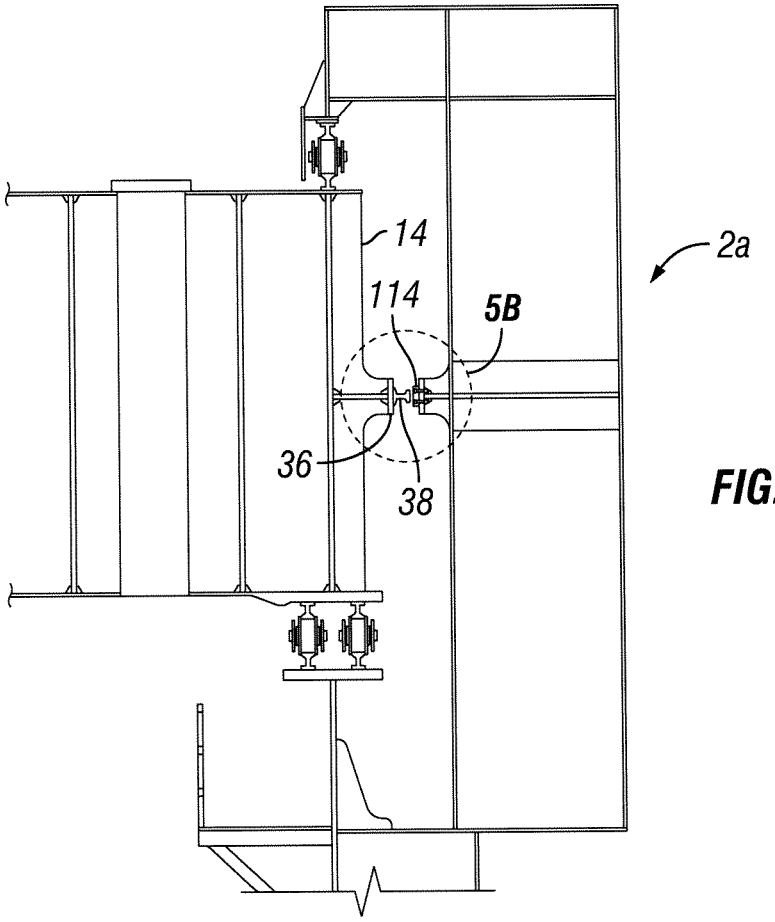
FIG. 5A is an enlarged fragment of the radial bearing assembly taken along line 5A--5A of FIG. 4.

FIG. 5A shows a side view of the radial bearing arrangement 2*a* according to the embodiment of FIG. 4, viewed along line 5A--5A of FIG. 4. Bearing pad 114 is positioned to contact the annular rail 38, which extends about the outer circumference of rail support 36 of turret 14 (see also FIG. 3).

Figure 5B:
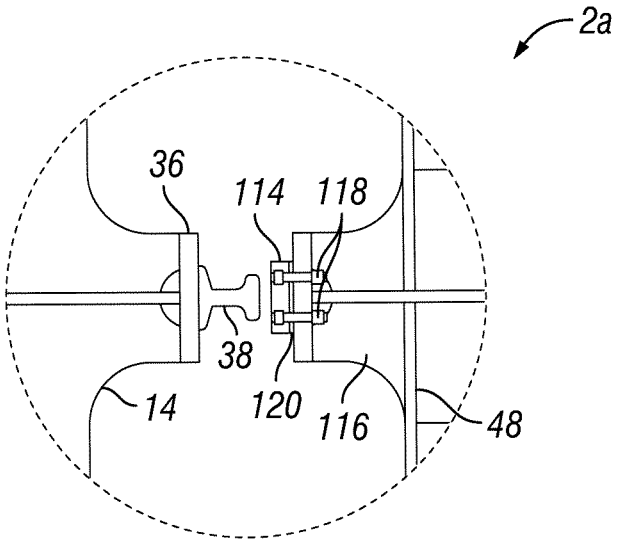
FIG. 5B is an enlarged fragment of the radial bearing assembly of FIG. 5A, as indicated by area 5B.

FIG. 5B is an enlarged similar view of FIG. 5A, showing details of how the bearing pad 114 is attached to concentric ring 48. An extension member 116 extends from concentric ring 48 toward turret 14. Bearing pad 114 is mounted on the end of extension member 116 and attached thereto by fasteners 118. The fasteners 118 may be any suitable fasteners including, for example, nuts and bolts. Shims 120 may be placed between the bearings pads 114 and the extension member 116 in order to more precisely place the bearing pads radially relative to the annular rail 38, thereby ensuring that the bearing pads 114 contact the rail 38 uniformly so that the load is distributed evenly across the pads.

Figure 6:
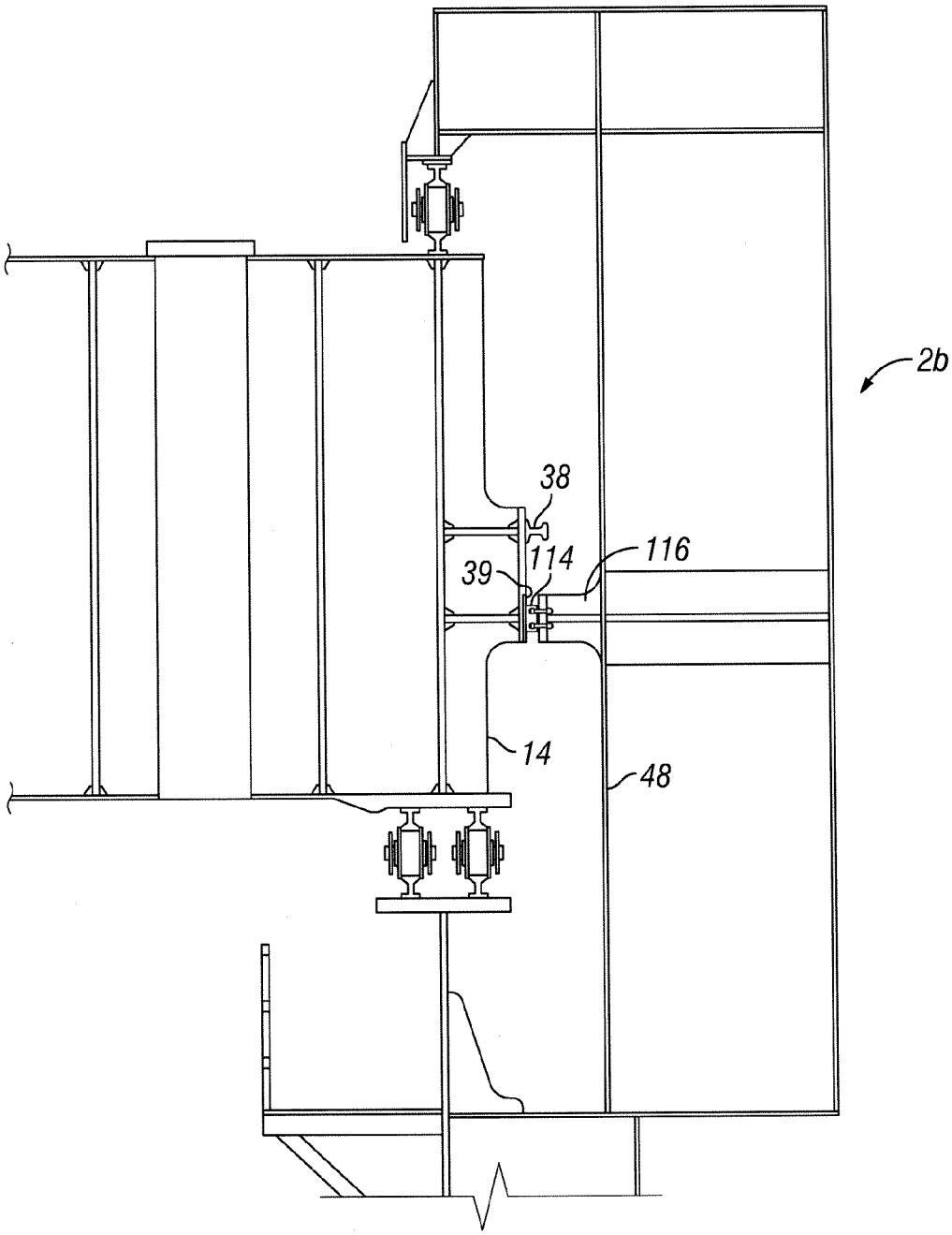
FIG. 6 is an enlarged fragment of another embodiment of the radial bearing assembly showing a bearing pad that slides upon a surface independent of the rail.

FIG. 6 shows another embodiment of the radial bearing arrangement 2*b*. The arrangement of FIG. 6 is similar to that of FIG. 4, except that the bearing pads 114 do not contact annular rail 38, but instead contact a bearing contacting surface 39 of the turret 14 which is offset from the annular rail 38. The bearing contacting surface 39 that may be stainless steel. An advantage of the embodiment of FIG. 6 is that grease, applied to the rail 38 to reduce friction between the rail 38 and rollers 104, is not removed from the rail by sliding contact with the bearing pads 114.

Figure 7:
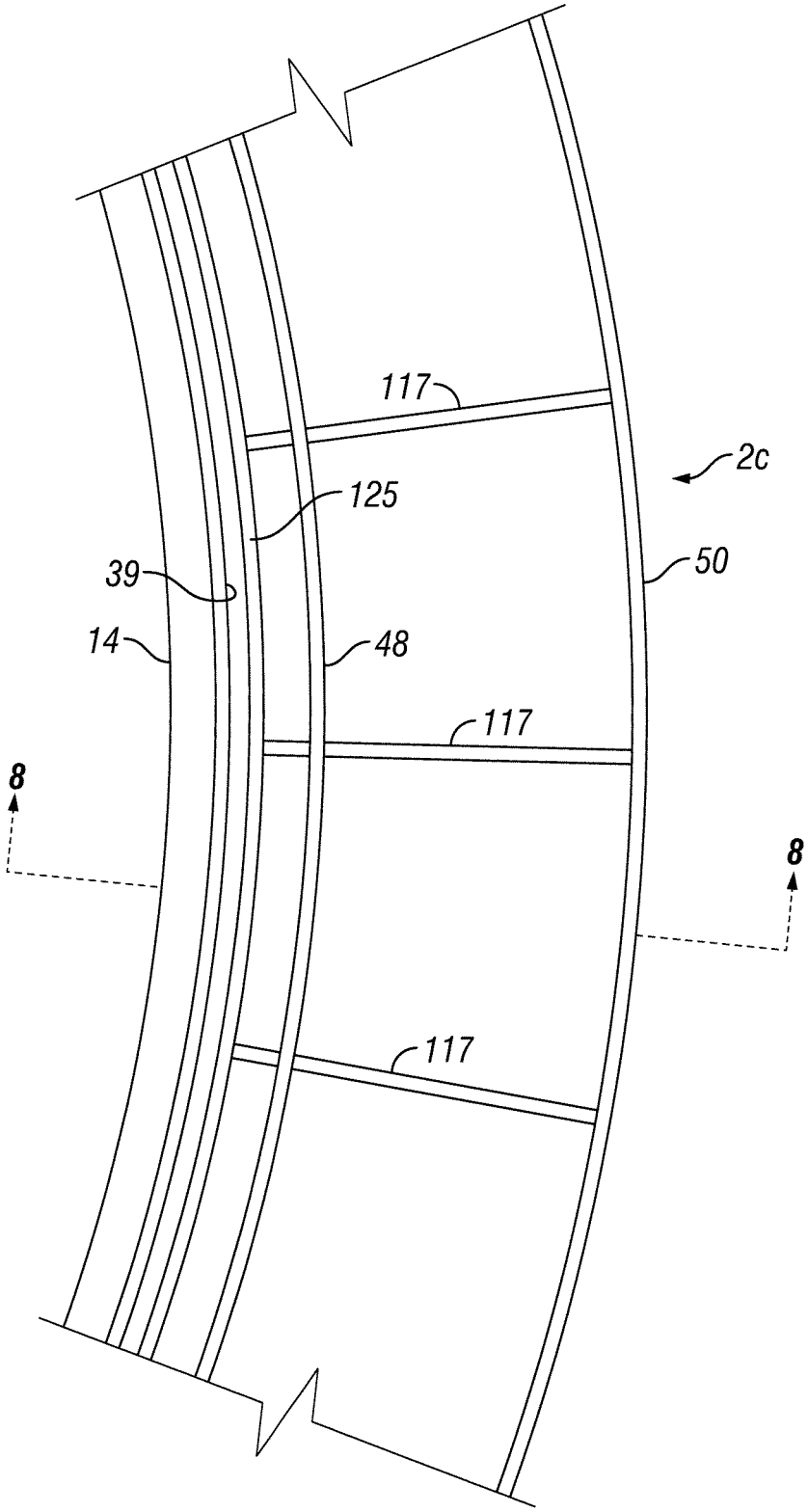
FIG. 7 is a plan view of a radial bearing pad arrangement for reacting radial loads between the turret and the vessel taken generally along 3--3 of FIG. 2, where radial roller assemblies have been replaced by bearing pads arcuately spaced about the outer circumference of the turret.
Figure 8:
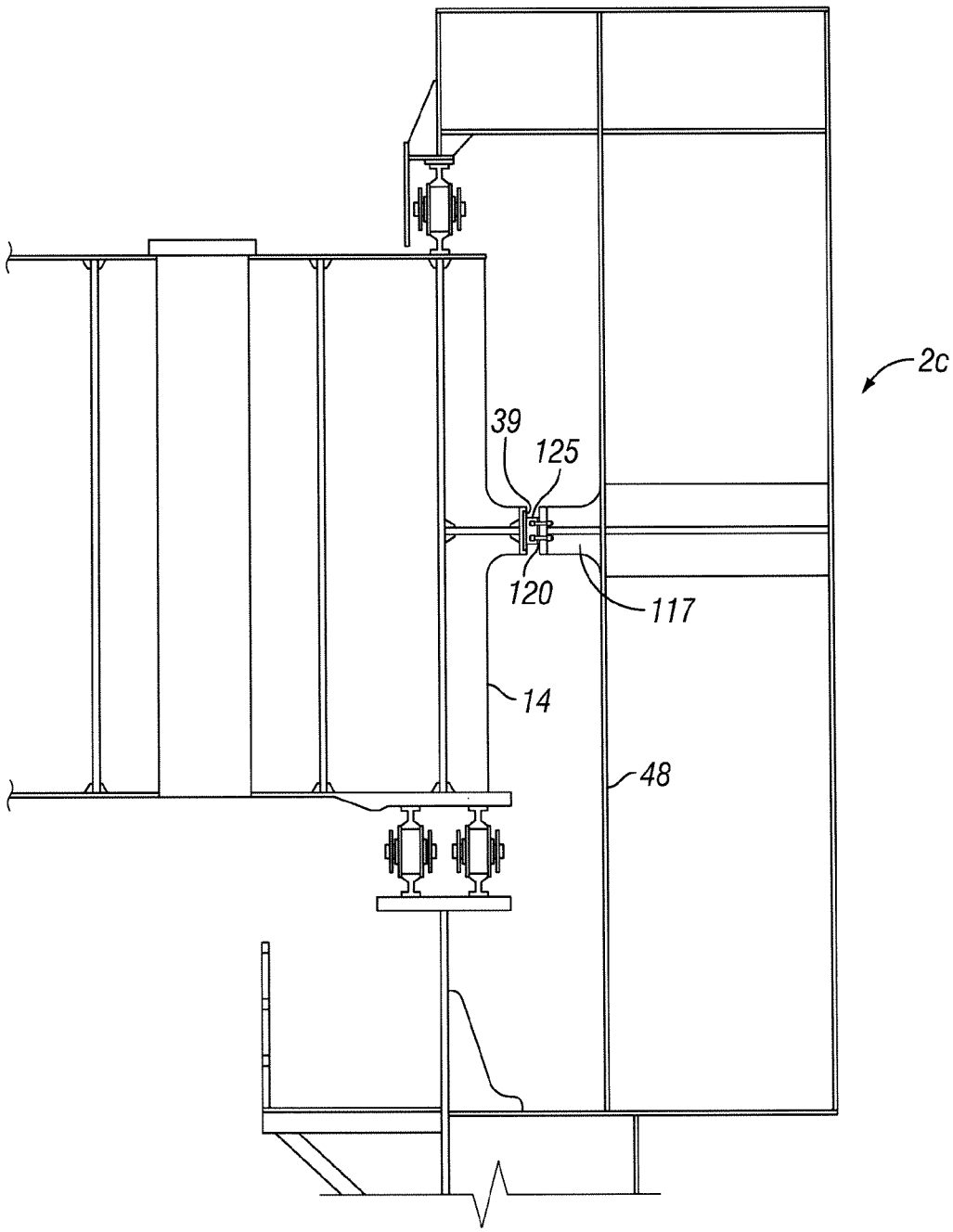
FIG. 8 is an enlarged fragment of the radial bearing pad arrangement viewed along line 8--8 of FIG. 7.

FIGS. 7 and 8 show an alternative embodiment of the invention in which the radial bearing arrangement 2*c* does not include radial bearing assemblies at all, but rather includes a ring of bearing pads 125. The bearing pad ring 125 may include plural segments, or a single ring of bearing material. Such an arrangement 2*c* reduces the complexity of the radial bearing arrangement 2 of FIGS. 1-3 and 4 by eliminating the radial bearing assemblies 74. FIG. 8 shows the bearing pad ring 125 attached to extension members 117. The bearing pads 125 are preferably positioned so that a gap exists between at least some of the pads 125 and the bearing contacting surface 39 to allow for deflections of the vessel 10 relative to the turret 14. Preferably, the bearing contacting surface 39 that contacts the bearing pads 125 is stainless steel. Shims 120 may be placed between the bearings pads 125 and the extension member 117 in order to more precisely place the bearing pads 125 radially relative to the turret 14, thereby ensuring that the bearing pads 125 contact the bearing contacting surface 39 uniformly so that the load is distributed evenly across the pads.

Figure 9:
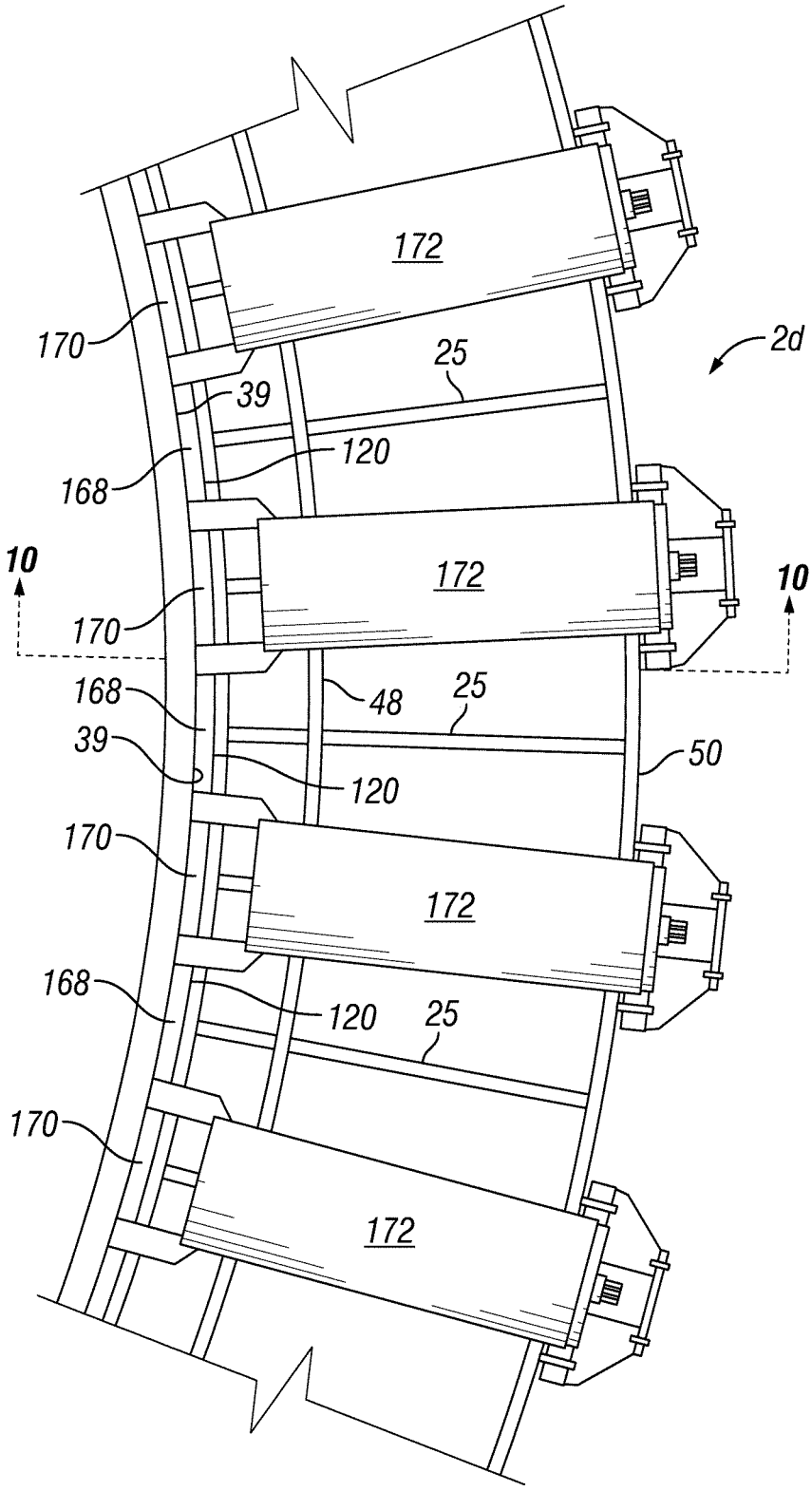
FIG. 9 is a plan view of a radial bearing arrangement for reacting radial loads between the turret and the vessel taken generally along line 3--3 of FIG. 2, where the plurality of rollers of the radial bearing assemblies have been replaced by radially moveable bearing pads, and further including fixed bearing pads placed alternately between the radial bearing assemblies.

FIG. 9 shows another embodiment 2*d* of the invention having radially fixed bearing pads 168, as well as radially moveable bearing pads 170 coupled to spring packs 172. The spring packs 172 are constructed in a manner similar to the radial bearing assemblies 74 described above and shown in FIG. 4, except that the rollers 104 are replaced by bearing pads 170 which are arranged to move radially in and out with respect to bearing contacting surface 39. Similar to the radial bearing assemblies 74 of FIG. 4, the spring packs 172 of FIG. 9 provide a radial force to the moveable bearing pads 170 that keeps them in contact with the turret 14 at all times. The spring packs 172 also provide compression when the vessel 10 moves toward the turret 14 due to radial loads on the turret 14 or ovaling of the moon pool 12 in response to wind and currents of the sea. The bearing pads 168, fixed to vessel 10 by means of members 50, 25, 48, serve the same purpose as the bearing pads 114 of FIG. 4. That is, when the spring packs 172 approach their maximum load, the turret 14 comes into contact with the fixed bearing pads 168, which take a share of the load and limit the load on the spring packs 172.

Figure 10:
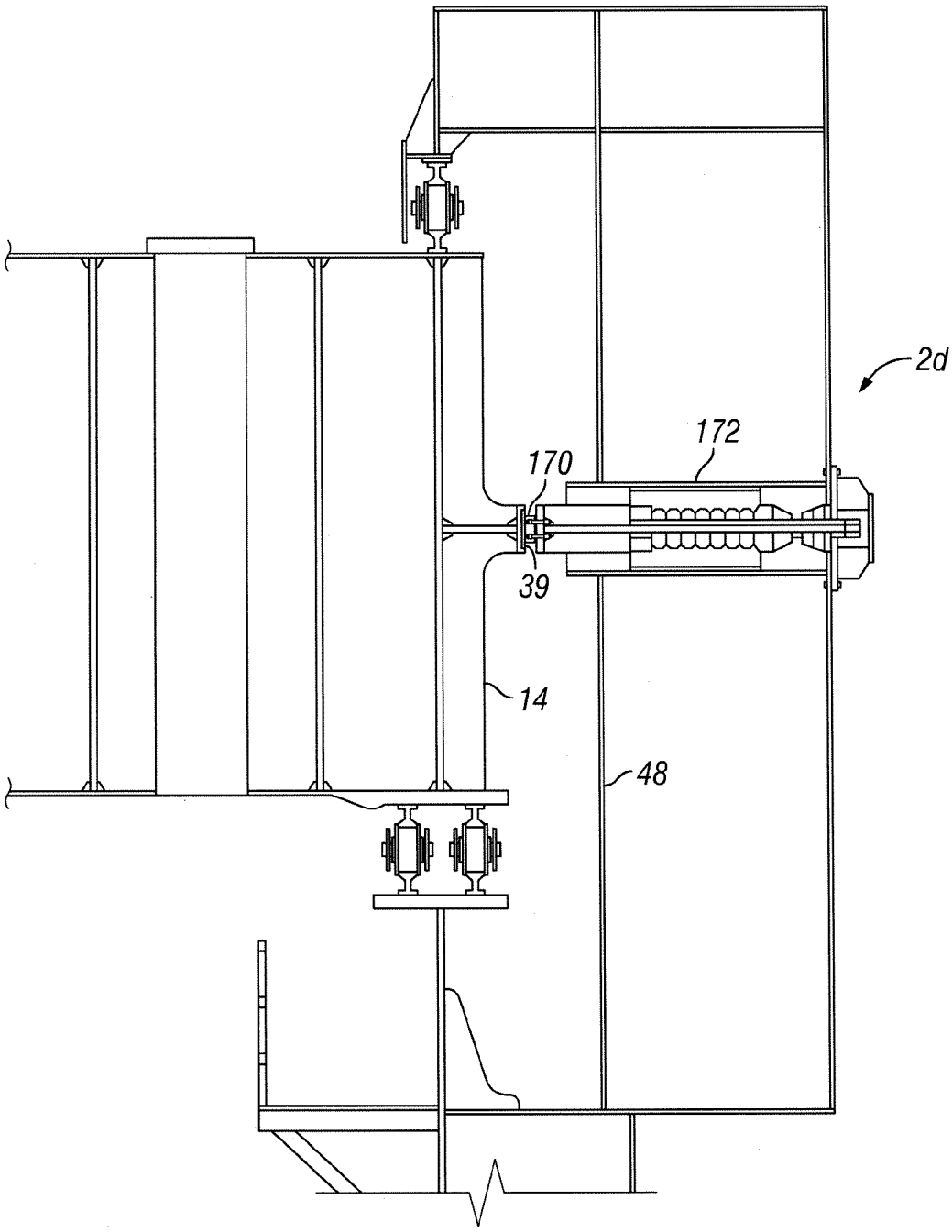
FIG. 10 is an enlarged fragment of the embodiment of the radial bearing assembly taken along line 10--10 of FIG. 9.

FIG. 10 shows a side view of the moveable bearing pad 170 and spring pack 172 according to the embodiment of FIG. 9. The spring pack 172 and moveable bearing pad 170 assembly are constructed in a manner similar to the radial bearing assembly 74 of, for example, FIG. 2.

The spring packs illustrated in the various embodiments described above may take many forms known to designers of mechanical arrangements. Spring packs 74 are illustrated in FIGS. 2, 3 and 4. Spring packs 172 are illustrated in FIGS. 9 and 10. The invention includes many different spring configurations of the prior art that can serve to force rollers and/or bearing packs toward the turret as described above.

While preferred embodiments of the present invention have been illustrated in detail, it is apparent that modifications and adaptations of the preferred embodiments will occur to those skilled in the art. However, it is to be expressly understood that such modifications and adaptations are in the spirit and scope of the present invention as set forth in the following claims.

What is claimed is:

1. A radial bearing arrangement (2*a*) comprising, a turret (14) carried by a vessel (10), said turret (14) having an outer circumferential rail (38) secured about its outer circumference;

a plurality of roller (104)/bearing assembly (74) arrangements attached to said vessel (10), said roller/bearing assembly arrangements placed circumferentially about said outer circumferential rail (38) of said turret (14), said roller/bearing assembly arrangements having a circumferential space between each of said arrangements (104, 74), with bearing assemblies (74) designed to urge associated rollers (104) into contact with said circumferential rail (38) and to limit radial movement of said vessel (10) relative to said turret (14); and a plurality of bearing pads (114) attached to said vessel (10), each bearing pad of said plurality of bearing pads (114) positioned in a circumferential space between said rollers (104), each of said bearing pads (114) arranged and designed to contact said circumferential rail (38) of said turret (14) under peak loading to further limit radial movement of said vessel (10) relative to said turret (14) and increase radial load capacity of said bearing arrangement.

2. The radial bearing arrangement (2*a*) of claim 1, further comprising, shims (120) positioned between said bearing pads (114) and said vessel (10), said shims (120) arranged and designed to adjust the radial position of said bearing pads (114) relative to said outer circumferential rail (38).

3. A radial bearing arrangement (2*b*) comprising, a turret (14) carried by a vessel (10), said turret (14) having an outer circumferential rail (38) secured about its circumference, and said circumferential rail (38) functioning as a circumferential roller/bearing surface of said turret (14), said turret (14) also having, a bearing pad contacting surface (39) that is vertically separated from said outer circumferential rail (38);

a plurality of rollers (104) attached to said vessel (10) via bearing assemblies (74), said bearing assemblies (74) arranged and designed to urge said rollers (104) into contact with said circumferential rail (38) and to limit radial movement of said vessel (10) relative to said turret (14); and a plurality of bearing pads (114) carried circumferentially by said vessel (10), said bearing pads (114) arranged and designed to contact said bearing pad contacting surface (39) of said turret (14) under peak loading to further limit radial movement of said vessel (10) relative to said turret (14) and increase radial load capacity of said bearing arrangement.

4. The radial bearing arrangement (2*b*) of claim 3, wherein said bearing contacting surface (39) is stainless steel.

5. The radial bearing arrangement (2*c*) of claim 3, wherein each of said plurality of said bearing pads (125) is positioned so that there is a gap between each of said bearing pads (125) and said turret (14).

6. The radial bearing arrangement (2*c*) of claim 3, wherein said bearing pad contacting surface (39) is stainless steel.

7. The radial bearing arrangement (2*c*) of claim 3, further comprising, shims (120) positioned between each of said bearing pads (125) and said vessel (10), said shims (120)

arranged and designed to adjust the horizontal position of said bearing pad (125) of said vessel (10) relative to said turret (14).

8. A radial bearing arrangement (2*d*) comprising, a turret (14) carried by a vessel (10), said turret (14) having a bearing pad contacting surface (39);

radially moveable bearing pads (170) attached to said vessel (10) via spring packs (172), said spring packs (172) arranged and designed to urge said moveable bearing pads (170) into contact with said bearing pad contacting surface (39), and to limit radial movement of said vessel (10) relative to said turret (14); said radially moveably bearing pads (170) arranged circumferentially about said bearing contact surface (39), said plurality of radially moveable bearing pads (170) having a circumferential space between each of said bearing pads (170), and fixed bearing pads (168) attached to said vessel (10) each one of said fixed bearing pads (168) positioned in one of said circumferential spaces between said plurality of radially moveable bearing pads (170), said fixed bearing pads (168) arranged and designed to contact said bearing pad contacting surface (39) under peak loading to further limit radial movement of said vessel (10) relative to said turret (14).

9. The radial bearing arrangement (2*d*) of claim 8, wherein said bearing pad contacting surface (39) is stainless steel.

10. The radial bearing arrangement (2*d*) of claim 8, further comprising, shims (120) positioned between said fixed bearing pads (168) and said vessel (10), said shims (120) arranged and designed to adjust the horizontal position of said fixed bearing pads (168) relative to said turret (14).

* * * * *